United States Patent [19]

Kopatz et al.

[11] Patent Number: 4,816,067

[45] Date of Patent: Mar. 28, 1989

[54] PROCESS FOR PRODUCING FINE SPHERICAL PARTICLES

[75] Inventors: Nelson E. Kopatz, Sayre; Jack E. Vanderpool, Laceyville, both of Pa.

[73] Assignee: GTE Products Corporation, Stamford, Conn.

[21] Appl. No.: 208,945

[22] Filed: Jun. 20, 1988

[51] Int. Cl.[4] ..... B22F 9/04

[52] U.S. Cl. ..... 75/0.5 B; 75/0.5 BA; 75/0.5 BB; 75/0.5 BC; 75/0.5 C; 65/213; 264/15

[58] Field of Search ..... 75/0.5 B, 0.5 BA, 0.5 BB, 75/0.5 BC, 0.5 C; 264/15; 65/213

[56] References Cited

U.S. PATENT DOCUMENTS

| | | | |
|---|---|---|---|
| 3,272,615 | 9/1966 | Hoffman et al. | 65/21.3 |
| 3,652,259 | 3/1972 | Knopp | 75/0.5 B |
| 4,592,781 | 6/1986 | Cheney et al. | 75/0.5 BB |
| 4,711,660 | 12/1987 | Kemp, Jr. | 75/251 |
| 4,715,878 | 12/1987 | Kopatz et al. | 65/21.3 |

*Primary Examiner*—Wayland Stallard

*Attorney, Agent, or Firm*—Donald R. Castle; L. Rita Quatrini

[57] ABSTRACT

A process is disclosed for producing fine spherical particles from a fine powder feed material which comprises entraining the powder feed material in a carrier gas, introducing the feed material and carrier gas through a powder port into a high temperature zone and maintaining the powder feed material in the high temperature zone for a sufficient time to melt at least about 50% by weight of the particles of the powder and to form droplets therefrom while at the same time allowing one or more streams of gas to come into contact intermittently with any powder which has accumulated in the vicinity of the powder port to keep the vicinity clear of powder to allow the powder feed to pass unobstructively through the powder port into the high temperature zone. The droplets are then cooled to form spherical particles.

2 Claims, No Drawings

PROCESS FOR PRODUCING FINE SPHERICAL PARTICLES

This invention relates to a process for producing fine spherical particles wherein the starting powder is passed through a powder port into a high temperature zone unobstructively by allowing one or more streams of gas to come into contact intermittently with the powder which has accumulated in the vicinity of the powder port to thereby keep this vicinity clear of powder. Processing can be carried out continuously without powder build up in the vicinity where the powder enters the high temperature zone.

BACKGROUND OF THE INVENTION

Fine spherical powders, especially alloy or elemental metal powders can be made by high temperature processing. Such processes are described in U.S. Pat. Nos. 3,909,241, 3,974,245, 4,592,781, 4,715,878, 4,502,885, 4,711,660 and 4,711,661.

One of the problems that occurs in this processing, especially plasma processing, is that powder tends to build up in the vicinity of the nozzle and powder port. This build up continues until the powder/carrier gas stream is effected and powder is not effectively injected into the plasma flame. This causes poor melting efficiency, thus decreasing the conversion efficiency to spherical powder. This build up can continue until the powder port is covered over and no powder is being injected into the flame. When any of these adverse occurrences are noted, the plasma processing system must be shut down temporarily to clean off the powder port/plasma nozzle area in order to effectively operate again. The plasma processing system is then started up again with this cycle repeating.

It would be a significant advance in the art to assure that powder is being injected consistently well into the flame by virtue of there being no partial or full blockages. Also, it would be a significant advance in the art if the plasma processing system could operate virtually continuously by virtue of not having to be shut down in order to clear off the powder port/plasma nozzle in order to remove fine powder build up.

SUMMARY OF THE INVENTION

In accordance with one aspect of this invention, there is provided a process for producing fine spherical particles from a fine powder feed material which comprises entraining the powder feed material in a carrier gas, introducing the feed material and carrier gas through a powder port into a high temperature zone and maintaining the powder feed material in the high temperature zone for a sufficient time to melt at least about 50% by weight of the particles of the powder and to form droplets therefrom while at the same time allowing one or more streams of gas to come into contact intermittently with any powder which has accumulated in the vicinity of the powder port to keep the vicinity clear of powder to allow the powder feed to pass unobstructively through the powder port into the high temperature zone. The droplets are then cooled to form spherical particles.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The present invention provides a method for high temperature processing powder especially fine powder to produce spherical particles. The method results in the elimination of the problem of build up of powder in the vicinity of the powder port. By this vicinity is meant the powder port exit through which powder exits the powder port and enters the high temperature zone and the point of entrance of the heat from the high temperature source through which the heat such as a flame enters the high temperature zone to come in contact with the powder. The point of entrance of the heat and the powder port exit are in close proximity to one another usually about ¼" from one another. The build-up occurs especially with fine powders. The build-up of power in the vicinity of the power port exit causes blockage preventing powder from entering the high temperature zone.

This invention is applicable to any powder material. However, it is especially suited to metal powders, and metal alloy powders, glass and ceramic powders.

The powder is entrained in a carrier gas such as argon, nitrogen and helium.

The powder entrained in the carrier gas is then passed through the high temperature zone and maintained in the high temperature zone at a temperature above the melting point of the powder for a sufficient time to melt at least about 50% by weight of the powder and form droplets therefrom. Some additional powder particles can be partially melted or melted on the surface and these can be spherical particles in addition to the melted portion. The preferred high temperature zone is a plasma.

As the powder exits the powder port and enters the high temperature zone through a powder port exit, one or more streams of gas are allowed to come in contact intermittently with any powder which has accumulated in the vicintiy of the powder port to clear the vicinity of the accumulated powder. In this way, the feed powder material passes unobstructively from the powder port into the high temperature zone. This is done by positioning one or more gas jets in the vicinity of the powder port and directed toward the powder port at the point of entrance of the heat into the high temperature zone. Preferably one jet is directed to a point adjacent to the actual point of entrance of the heat into the high temperature zone and in the vicinity of the powder port. Preferably the another jet is directed at the powder port itself. Usually the gas jets are positioned from about 1" to about 2" away from entrance point of the heat into the high temperature zone. This allows the gas stream or streams to essentially completely clear the powder port and heat entrance area of the accumulated powder. Gas is intermittently directed toward the normal area of powder build-up. The build up of powder, if any, is removed and the tendency toward obstructive build-ups is eliminated. The gas jets can be of any variety from a simple metal tube to a gas nozzle or blow off jet.

The gas can be of any nature according to the high temperature reaction that is desired but is generally inert. Some preferred gasses are argon, nitrogen and helium. The gas pressure can be generally low, for example, 50 psig or increased to be more effective, to -300 psig.

In accordance with a preferred embodiment in a plasma process, a ballast can be present in the gas line or lines prior to the gas jet nozzle in order to give higher volume during a short blast. The gas blasts are normally controlled by a solenoid valve in conjunction with a timer-relay. The valve normally opens and closes for about 0.5 second intervals over about a 5 second period every 10 minutes. These times can be adjusted over wide ranges as needed. The gas from the gas jet nozzle does disturb the injection of powder into the high temperature zone but the time when the gas is flowing is equivalent to about 0.5% if the run time so its effect on sphericity of the particles is minimal. A low flow of gas, ≦20 scfm is passed through the gas jet at all times. This is to eliminate the overheating and potential melting of the gas jet nozzle due to its proximity to the plasma flame. This low flow of gas does not interfere with the melting of the powder particles.

Details of the principles and operation of plasma reactors are well known. The plasma has a high temperature zone, but in cross section the temperature can vary typically from about 5500° C. to about 17,000° C. The outer edges are at lower temperatures and the inner part is at a higher temperature. The retention time depends upon where the particles entrained in the carrier gas are injected into the nozzle of the plasma gun. Thus, if the particles are injected into the outer edge, the retention time must be longer, and if they are injected into the inner portion, the retention time is shorter. The residence time in the plasma flame can be controlled by choosing the point at which the particles are injected into the plasma. Residence time in the plasma is a function of the physical properties of the plasma gas and the powder material itself for a given set of plasma operating conditions and powder particles. Larger particles are more easily injected into the plasma while smaller particles tend to remain at the outer edge of the plasma jet or are deflected away from the plasma jet.

As the material passes through the high temperature zone and cools, it is rapidly solidified. Generally the major weight portion of the material is converted to spherical particles. Generally greater than about 75% and most typically greater than about 85% of the material is converted to spherical particles by the high temperature treatment. Nearly 100% conversion to spherical particles can be attained. The major portion of the spherical particles are less than about 20 micrometers in diameter. The particle size of the plasma treated particles is largely dependent of the size of the starting powder material.

After cooling and resolidification, the resulting high temperature treated material can be classified to remove the major spheroidized particle portion from the essentially non-spheroidized minor portion of particles and to obtain the desired particle size. The classification can be done by standard techniques such as screening or air classification. The unmelted minor portion can then be reprocessed according to the invention to convert it to fine spherical particles.

Spherical particles have an advantage over non-spherical particles in injection molding. The lower surface area of spherical particles as opposed to non-spherical particles of comparable size, and the flowability of spherical particles makes spherical particles easier to mix with binders and easier to dewax.

To more fully illustrate this invention, the following non-limiting example is presented.

EXAMPLE

An argon-helium plasma flame is generated with a gas flow of about 30 l/min. Ar, and about 10 l/min. He with about 16.2 KW of input powder of about 360 amps and about 45 volts. Iron powder with about 40% by weight cobalt made from hydrometallurgical and hydrogen processing having a mean size of about 10 micrometers in diameter is introduced into the plasma flame at a rate of about 75 g/min. being fed by an argon carrier gas at a flow rate of about 3l/min. and being injected into the flame from a powder port. The powder is melted in flight rapidly solidified and collected in a chamber. Two blow off gas jet nozzles are mounted in the vicinity of, that is, about 1–2" away from the plasma gun nozzle, and the powder port exit into the plasma zone which are all in close proximity to one another, that is about ¼" away from one another. One jet is positioned such that the gas exiting the jet is directed at the powder port exit and the other gas jet positioned such that the gas exiting the gas jet is directed at the face of the plasma nozzle. A flow of argon gas is passing through these gas jet nozzles continuously. This flow is about 10 l/min. and serves as a cooling gas to prevent the gas jet nozzles from melting. It has no effect on the process. Intermittently high flows of gas exit these gas jets. This serves to dislodge any powder build-up in the plasma nozzle/powder port vicinity that might inhibit injection of powder into the plasma flame. Selenoid valves operated by a timer relay open and close on 0.5 second intervals for a 5 second period every 10 minutes. The supply gas is normally at about 50 psig and the gas is delivered to the selenoid valve and to the blow off gas jet nozzle via ¼" tubing. This procedure permits virtually continuous operation of the plasma process (usually a minimum of about 3–4 hours) whereas without them deleterious build-ups of powder necessitating shutdowns can occur as frequently as at ½ hour intervals.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing fine spherical particles from a fine powder feed material, said process comprising:

(a) entraining said powder feed material in a carrier gas;

(b) introducing said powder feed material and said carrier gas through a powder port into a high temperature zone generated by a high temperature source and maintaining said powder in said high temperature zone for a sufficient time to melt at least about 50% by weight of the particles of said powder material and to form droplets therefrom while at the same time allowing one or more streams of gas to come into contact intermittently with any powder which has accumulated in the vicinity of said powder port to keep said vicinity clear of powder to allow said powder feed to pass unobstructively through said powder port into said high temperature zone; and (c) cooling said droplets to form spherical particles of the resulting high temperature treated material.

2. A process of claim 1 wherein said high temperature zone is a plasma.

* * * * *